US007299645B2

(12) United States Patent
Oshitani et al.

(10) Patent No.: US 7,299,645 B2
(45) Date of Patent: Nov. 27, 2007

(54) EJECTOR CYCLE AND EJECTOR DEVICE

(75) Inventors: Hiroshi Oshitani, Toyota (JP); Hirotsugu Takeuchi, Nagoya (JP); Takayuki Sugiura, Anjo (JP)

(73) Assignee: DENSO Corporation, Kariya (JP)

( * ) Notice: Subject to any disclaimer, the term of this patent is extended or adjusted under 35 U.S.C. 154(b) by 499 days.

(21) Appl. No.: 11/035,334

(22) Filed: Jan. 13, 2005

(65) Prior Publication Data

US 2005/0155374 A1 Jul. 21, 2005

(30) Foreign Application Priority Data

Jan. 21, 2004 (JP) ..... 2004-013491

(51) Int. Cl.
*F25B 1/06* (2006.01)

(52) U.S. Cl. ..... 62/191; 62/500

(58) Field of Classification Search ..... 62/116, 62/170, 191, 503, 512, 527, 528; 137/111, 137/114

See application file for complete search history.

(56) References Cited

U.S. PATENT DOCUMENTS

| | | | | |
|---|---|---|---|---|
| 6,606,873 | B2 * | 8/2003 | Takeuchi | 62/191 |
| 6,782,713 | B2 * | 8/2004 | Takeuchi et al. | 62/500 |
| 6,880,362 | B2 * | 4/2005 | Choi et al. | 62/500 |
| 2004/0255613 | A1 * | 12/2004 | Choi et al. | 62/500 |

FOREIGN PATENT DOCUMENTS

JP 2003-090635 3/2003

* cited by examiner

*Primary Examiner*—Marc Norman
(74) *Attorney, Agent, or Firm*—Harness, Dickey & Pierce, PLC

(57) ABSTRACT

The present invention has an object to provide an ejector cycle and an ejector, according to which a sufficient cooling performance can be obtained even when the input amount of the refrigerant to the ejector is decreased. A passage changeover means having a bypass channel is formed in an ejector. The passage changeover means opens the bypass channel in a bypass cooling operation, in which an input amount of the refrigerant to the ejector is decreased due to a low ambient temperature, and so on. Accordingly, in this bypass cooling operation, the refrigerant from an outside heat exchanger to the ejector bypasses an ejector nozzle and flows to an evaporator through the bypass channel.

11 Claims, 12 Drawing Sheets

EJECTOR CYCLE AND EJECTOR DEVICE

CROSS REFERENCE TO RELATED APPLICATION

This application is based on Japanese Patent Application No. 2004-13491 filed on Jan. 21, 2004, the disclosure of which is incorporated herein by reference.

FIELD OF THE INVENTION

The present invention relates to an ejector cycle and an ejector device used in the ejector cycle, in which high-pressure refrigerant from a compressor is depressurized and expanded through the ejector and gas-phase and low-pressure refrigerant (at a low-pressure side at which the refrigerant has been evaporated) is sucked in by jet flow of the refrigerant ejected from an ejector nozzle with a high fluid velocity. As a result, suck-in pressure of the refrigerant by the compressor is increased by converting expansion energy of the refrigerant into pressure energy.

BACKGROUND OF THE INVENTION

FIG. 11 is a schematic view showing a conventional ejector cycle, wherein a numeral 10 designates a compressor, a numeral 20 is a heat exchanger, a numeral 30 is an evaporator, and a numeral 50 is a gas-liquid separator. In this conventional ejector cycle, a bypass passage 70 and a passage changeover valve 91 such as a three way valve are provided, so that the refrigerant bypasses the ejector 4 when an input amount of the refrigerant to be supplied to the ejector 4 becomes lower.

In case of a bypass flow of the refrigerant bypassing the ejector 4, a refrigerant passage is changed over by the passage changeover valve 91, so that the high-pressure refrigerant discharged from the heat exchanger 20 flows into the bypass passage 70. Then the refrigerant flows through a restriction valve 51, at which the high-pressure refrigerant is depressurized and expanded, and through the evaporator 30, at which air is cooled down, and flows into the gas-liquid separator 50. In FIG. 11, a numeral 52 designates a check valve to prevent the high-pressure refrigerant from flowing back from the bypass passage 70 into the gas-liquid separator 50. A numeral 60 is an inside heat exchanger for heat exchanging between the high-pressure refrigerant discharged from the heat exchanger 20 and the low-pressure refrigerant to be sucked into the compressor 10.

FIG. 12 is a schematic view showing a conventional ejector cycle used in a heat pump air-conditioning apparatus, wherein a numeral 80 designates a heat exchanger for a heating operation, and a numeral 81 is a depressurizing valve for depressurizing the refrigerant. The heat exchanger 80 and the depressurizing valve 81 are provided at a downstream side of the compressor 10, wherein inside air is heated at the heat exchanger 80 by heat exchanging between the compressed refrigerant from the compressor 10 and the inside air. A three way valve 92 is provided between the ejector 4 and the heat exchanger 30 for a cooling operation, the three way valve 92 (on a suck-in side) is connected with the three way valve 91 (on an ejecting side) by a refrigerant passage, in which a restriction valve 93 is provided.

According to the above ejector cycle, the refrigerant simply flows through the heat exchanger 80 and the depressurizing valve 81 during the cooling operation, and the heat of the refrigerant is radiated at the outside heat exchanger 20. Then the refrigerant is depressurized at the ejector 4 and the low-pressure refrigerant is sucked from the heat exchanger 30 for the cooling operation. In the case that the cooling operation is performed in which the refrigerant bypasses the ejector 4, the refrigerant is depressurized at the restriction valve 93 through the three way valve 91 and supplied to the heat exchanger 30 through the three way valve 92. In the case that the heating operation is performed, the air is heated at the heat exchanger 80 by the high-pressure and high-temperature refrigerant compressed at the compressor 10. The refrigerant is then depressurized by the depressurizing valve 81, absorbs the heat from the outside air at the heat exchanger 20, and simply flows through the ejector 4.

The inventors of the present invention applied for another patent application (Japanese Patent Publication No. 2003-90635), which discloses an ejector cycle. In the ejector cycle, a bypass channel is provided in the ejector, so that the high-pressure refrigerant discharged from a heat exchanger bypasses a nozzle of the ejector, and a bypass passage is provided to supply the refrigerant to an evaporator to remove frost at the evaporator. In the ejector, a valve for opening and closing the bypass channel is operated by an actuator, which also drives a needle valve for adjusting an opening area of the nozzle.

In the above mentioned prior arts, namely the refrigerating cycle with the ejector, however, it is a drawback in that a sufficient cooling performance can not be obtained when an input amount of the refrigerant to be supplied to the ejector is low and thereby a sufficient amount of the refrigerant is not supplied to the evaporator, in those cases that an outside temperature is low, a wind speed at a front side of the outside heat exchanger is high, or an inside temperature is high.

And the above Patent Publication No. 2003-90635 does not either specifically disclose or imply an idea for increasing the cooling performance or obtaining a sufficient cooling performance when the input amount of the refrigerant to the ejector is low.

Furthermore, in the conventional ejector cycle, it is another drawback in that a heating operation is not sufficiently performed due to a large pressure loss at the ejector, when the ejector cycle is used in the heat pump type air-conditioning apparatus.

SUMMARY OF THE INVENTION

The present invention is made in view of the foregoing problems, and has an object to provide an ejector cycle and an ejector, according to which a sufficient cooling performance can be obtained in such a manner that the refrigerant bypasses an ejector nozzle and thereby a sufficient amount of the refrigerant flows into an evaporator, when the input amount of the refrigerant to the ejector is decreased.

It is another object of the present invention to provide the ejector, in which a bypass channel for the refrigerant bypassing the ejector nozzle is formed in a simple manner.

It is a further object of the present invention to provide the ejector cycle, according to which a pressure loss of the refrigerant bypassing the ejector nozzle is minimized.

According to a feature of the present invention, an ejector comprises a (first) passage changeover means having a (first) bypass channel formed in the ejector. The passage changeover means opens the bypass channel in a bypass cooling operation, in which an input amount of the refrigerant to the ejector is decreased due to a low ambient temperature, and so on. Accordingly, in this bypass cooling operation, the refrigerant from an outside heat exchanger to the ejector bypasses an ejector nozzle and flows to an evaporator through the bypass channel.

In one of the embodiments of the present invention, a bypass passage is provided between a bypass port of the ejector and the evaporator, and a depressurizing valve is provided in the bypass passage and between the bypass port and the evaporator, so that the refrigerant to be supplied to the evaporator is depressurized.

According to another feature of the present invention, the ejector further comprises a second passage changeover means having a second bypass channel formed in the ejector, one end of which is communicated with the first bypass channel and the other end of which is communicated with a suction port of the ejector, through which a gas-phase refrigerant is sucked into the ejector from the evaporator in a normal cooling operation. A (second) movable valve is movably arranged in the second bypass channel to open and close the second bypass channel. In the normal cooling operation, the valve closes the second bypass channel, whereas it opens the second bypass channel when the first bypass channel is opened in the bypass cooling operation.

In such an arrangement, the refrigerant bypasses the ejector nozzle in the bypass cooling operation and flows to the evaporator through the first and second bypass channels, wherein the second bypass channel functions as a depressurizing means for the refrigerant to be supplied to the evaporator. According to such arrangement, an additional bypass passage connecting the ejector with the evaporator is eliminated.

According to a further feature of the present invention, a heat radiating device and a depressurizing valve are additionally provided between the compressor and the outside heat exchanger, so that the high-pressure and high-temperature refrigerant from the compressor flows at first through the heat radiating device for heating the air around the heat radiating device, to perform a heating operation.

According to a further feature of the present invention, the ejector further comprises a third passage changeover means having a third bypass channel formed in the ejector, one end of which is communicated with an inlet port of the ejector and the other end of which is communicated with a suction portion of the ejector at a downstream side of the nozzle. A (third) movable valve is movably arranged in the third bypass channel to open and close the third bypass channel. In the normal cooling operation, the valve closes the third bypass channel, due to a high fluid pressure of the refrigerant flowing in the inlet port, whereas it opens the third bypass channel due to a lower fluid pressure when the ejector cycle is operated in the heating operation.

According to such an arrangement, a pressure loss of the refrigerant can be suppressed to a small amount, since the refrigerant bypasses the ejector nozzle and flows back to the gas-liquid separator through the bypass channels having a low fluid resistance.

BRIEF DESCRIPTION OF THE DRAWINGS

The above and other objects, features and advantages of the present invention will become more apparent from the following detailed description made with reference to the accompanying drawing. In the drawing.

DETAILED DESCRIPTION OF THE PREFERRED EMBODIMENTS (First Embodiment)

The embodiments of the present invention will be described hereunder with reference to the accompanying drawings.

Figure 1:
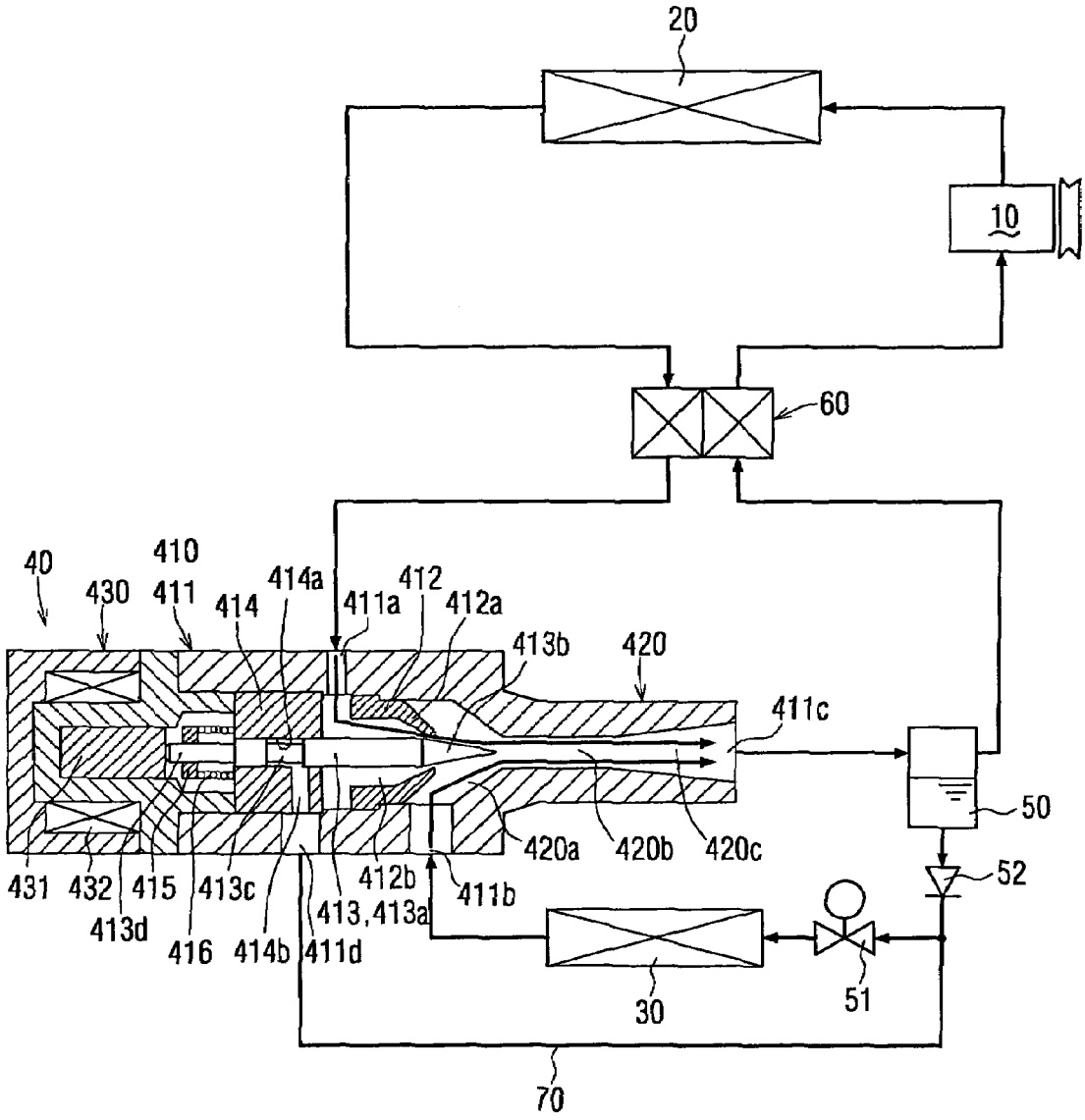
FIG. 1 is a schematic view of an ejector cycle according to a first embodiment of the present invention, and partly showing a cross sectional view of an ejector, in which the ejector cycle is operated in a cooling operation.

FIG. 1 shows an ejector cycle used in a cooling apparatus, according to a first embodiment of the present invention, in which the ejector cycle is operated in a cooling operation;

A numeral 10 designates a compressor driven by a driving source, such as an electric motor, for sucking and compressing refrigerant. A numeral 20 designates an outside heat exchanger for cooling down the refrigerant by heat exchanging the high-temperature and high-pressure refrigerant from the compressor 10 with outside air. A numeral 30 designates a heat exchanger for the cooling operation (also referred to as an evaporator) for absorbing heat from the air around the evaporator 30, by evaporating liquid-phase refrigerant and thereby heat exchanging the liquid-phase refrigerant with the air. And a numeral 40 designates an ejector for depressurizing and expanding the refrigerant discharged from the outside heat exchanger 20 and thereby sucking in the gas-phase refrigerant evaporated at the evaporator 30, and further converting the expansion energy into the pressure energy to increase the pressure of the refrigerant to be sucked into the compressor 10. The detailed structure of the ejector will be explained later.

A numeral 50 is a gas-liquid separator, into which the refrigerant flows from the ejector 40, and which separates the refrigerant into the gas-phase and liquid-phase refrigerant and stores those refrigerants therein. The thus separated gas-phase refrigerant is sucked into the compressor 10 and the liquid-phase refrigerant is sucked into the evaporator 30. A depressurizing valve 51 is provided in a refrigerant passage connecting the gas-liquid separator 50 with the evaporator 30, for depressurizing the refrigerant sucked into the evaporator 30 to surely depressurize the pressure (evaporation pressure) in the evaporator 30, wherein a pressure loss is generated when the refrigerant flows through the valve 51.

A numeral 60 is an inside heat exchanger for heat exchanging the high-pressure refrigerant discharged from the outside heat exchanger 20 with the low-pressure refrigerant to be sucked into the compressor 10. A numeral 70 is a bypass passage for connecting the ejector 40 with the depressurizing valve 51 to supply the high-pressure refrigerant to an upstream side of the depressurizing valve 51, when the refrigerant bypasses an ejector nozzle 412 of the ejector 40. A numeral 52 is a check valve for preventing the high-pressure refrigerant from flowing from the bypass passage 70 into the gas-liquid separator 50.

The ejector 40 comprises a main body portion 410, a pipe portion 420 and a driving portion 430. The main body portion 410 and the pipe portion 420 have an integrally formed common ejector body 411 of a cylindrical shape, which is fixed to the driving portion 430 by a generally known fixing means. An inlet port 411*a* is formed at a longitudinally middle portion of the common ejector body 411, through which the refrigerant discharged from the outside heat exchanger 20 flows into an inside of the ejector 40.

The main body portion 410 comprises an ejector nozzle 412, a needle 413 and a needle guide 414. The ejector nozzle 412 is formed into a ring shape, and a nozzle portion 412*a* (having an opening) is formed at a forward end of the ejector nozzle 412, wherein the nozzle portion 412*a* is tapered so that an inner diameter thereof decreases toward the forward end.

The needle 413 comprises a cylindrical portion 413*a* and a conical end 413*b* at its forward end, wherein an outer diameter of the conical end 413*a* decreases toward the forward end.

The needle 413 is inserted at its rear end into a guide bore 414*a* of the needle guide 414, so that the needle is axially movable. The forward end of the needle 413 is further inserted into the opening formed at the forward end of the ejector nozzle 412, to form a space between the opening of the nozzle portion 412*a* and an outer surface of the conical end 413*b*, wherein an opening area of the space is adjusted by moving the needle 413 in the axial direction.

When the needle 413 is moved to the right hand end, the space between the opening of the nozzle portion 412*a* and the outer surface of the needle 413 is closed by the outer surface of the cylindrical portion 413*a*. When the space between the opening of the nozzle portion 412*a* and the needle 413 is opened by the conical end 413*b*, a main flow passage 412*b* is formed at such a ring shaped space to communicate the inlet port 411*a* with the pipe portion 420. The needle guide 414 is fixed to the common ejector body 411.

The ejector nozzle 412, the needle 413 and the needle guide 414 are made of a metal having a high corrosion resistance, such as SUS316L and SUS304L. A surface treatment of DLC (Diamond Like Carbon) is applied to the needle 413 to increase its sliding characteristic and wear resistance.

The pipe portion 420 is formed at an end of the ejector 40 on a side of the nozzle portion 412*a*. The pipe portion 420 is formed into a cylindrical shape having a discharge passage longitudinally extending for passing the refrigerant ejected from the nozzle portion 412*a*. The nozzle portion 412*a* is inserted into the discharge passage at its one end, and the other end of the discharge passage is formed as a discharge port 411*c* to be connected to the gas-liquid separator 50. A suction port 411*b* is formed at a longitudinally middle portion of the pipe portion 420, so that the suction port 411*b* is communicated with the discharge passage. The suction port 411*b* is connected to the evaporator 30.

A numeral 420*a* is a suction portion for sucking the refrigerant from the evaporator 30 by refrigerant flow (jet flow) having a high velocity ejected from the ejector nozzle 412. A numeral 420*b* is a mixing portion for mixing the refrigerant ejected from the ejector nozzle 412 with the refrigerant sucked from the evaporator 30. A numeral 420*c* is a defusing portion for converting the speed energy into the pressure energy while mixing the refrigerants from the nozzle portion 412 and the evaporator 30, to thereby increase the pressure of the refrigerant. The suction portion 420*a*, the mixing portion 420*b* and the defusing portion 420*c* are formed by the common ejector body 411, in which the ejector nozzle 412 is housed. The common ejector body 411 as well as the ejector nozzle 412 is made of a stainless steel.

A driving flow (the refrigerant from the ejector nozzle 412) and a suction flow (the refrigerant from the evaporator 30) are mixed at the mixing portion 420*b* in such a manner that a sum of the kinetic momentums of the driving flow and the suction flow is conserved, and thereby the pressure (static pressure) of the refrigerant is also increased at the mixing portion 420*b*. The speed energy (dynamic pressure) of the refrigerant is converted into the pressure energy (static pressure) by gradually increasing a cross sectional area of the discharge passage at the defusing portion 420*c*, and thereby the pressure of the refrigerant is increased at both of the mixing portion 420*a* and the defusing portion 420*c*, which are collectively referred to as a pressure increasing portion.

In an ideal ejector, the refrigerant pressure is increased at the mixing portion of the ejector while the sum of the kinetic momentums of the driving and suction flows is conserved, and the refrigerant pressure is further increased at the defusing portion while conserving the energy. Accordingly, in the embodiment of the present invention, the cross sectional area of the opening of the nozzle 412 is adjusted by an axial displacement of the needle 413 depending on a thermal load required at the evaporator 30.

The driving portion 430 drives the needle 413 in the axial direction and is arranged at an end of the common ejector body 411 opposite to the ejector nozzle 412. The driving portion 430 comprises an electromagnetic actuator having a plunger 431 and a coil portion 432 for driving the plunger 431. A small diameter portion 413*d* is formed at the rear end of the needle 413, a stopper 415 is formed at a middle portion of the small diameter portion 413*d*, and a coil spring 416 is arranged between the needle guide 414 and the stopper portion 415 to urge the stopper portion 415 (and the needle 413) toward the plunger 431. As a result, the needle 413 is driven by the plunger while the rear end of the needle 413 is always in contact with the plunger 431.

A (first) bypass channel 414*b* is formed in the needle guide 414, wherein the bypass channel 414*b* extends in a direction perpendicular to the axial line of the guide bore 414*a*, so that the bypass channel 414*b* communicates the inside space of the guide bore 414*a* with a bypass port 411*d* formed at the common ejector body 411. A circular groove 413*c* as a communication groove is formed at the cylindrical portion 413*a* of the needle 413, so that the inside space is formed by the guide bore 414*a* and the circular groove 413*c*.

In the above embodiment, a first passage changeover means is constituted by the needle 413, the circular groove 413*c* of the needle 413 and the (first) bypass channel 414*b* of the needle guide 414. In the embodiment, the communication groove is formed by the circular groove 413*c*. It is, however, not limited to the circular groove. The circular groove 413*c* can be replaced by a longitudinally extending groove formed on the outer surface of the cylindrical portion 413*a*, or an axially extending bore formed at an inside of the cylindrical portion 413*a*.

An operation of the ejector 40 and the ejector cycle will be explained.

(A Normal Cooling Operation)

When the compressor 10 starts its operation, the gas-phase refrigerant is sucked from the gas-liquid separator 50 into the compressor 10, as shown in FIG. 1, and the compressed refrigerant is then pumped out to the outside heat exchanger 20. The refrigerant cooled down at the heat exchanger 20 is discharged to the ejector 40 through the inlet port 411*a*, in which the refrigerant is expanded and depressurized by the ejector nozzle 412 to suck the refrigerant from the evaporator 30 (the inside heat exchanger). The refrigerant from the ejector nozzle 412 and the refrigerant sucked from the evaporator 30 are mixed at the mixing portion 420*b*, and the dynamic pressure of the refrigerant is converted into the static pressure at the defusing portion 420*c*, and finally the refrigerant returns to the gas-liquid separator 50.

In this operation, the liquid-phase refrigerant flows from the gas-liquid separator 50 into the evaporator 30 because the refrigerant of the evaporator 30 is sucked into the ejector 40, wherein the liquid-phase refrigerant flowing into the evaporator 30 will be evaporated at the heat exchanger 30 by absorbing the heat from the ambient air.

In this normal cooling operation, the needle 413 is moved back and forth by the driving portion 430 to adjust the cross sectional area of the opening at the nozzle portion 412*a*, depending on the thermal load at the evaporator 30. Since an entire portion of the circular groove 413*c* is placed in the guide bore 414*a* of the needle guide 414, during the above movement of the needle 413, the bypass channel 414*b* is not communicated with the inlet port 411*a*.

(A Bypass Cooling Operation)

Figure 2:
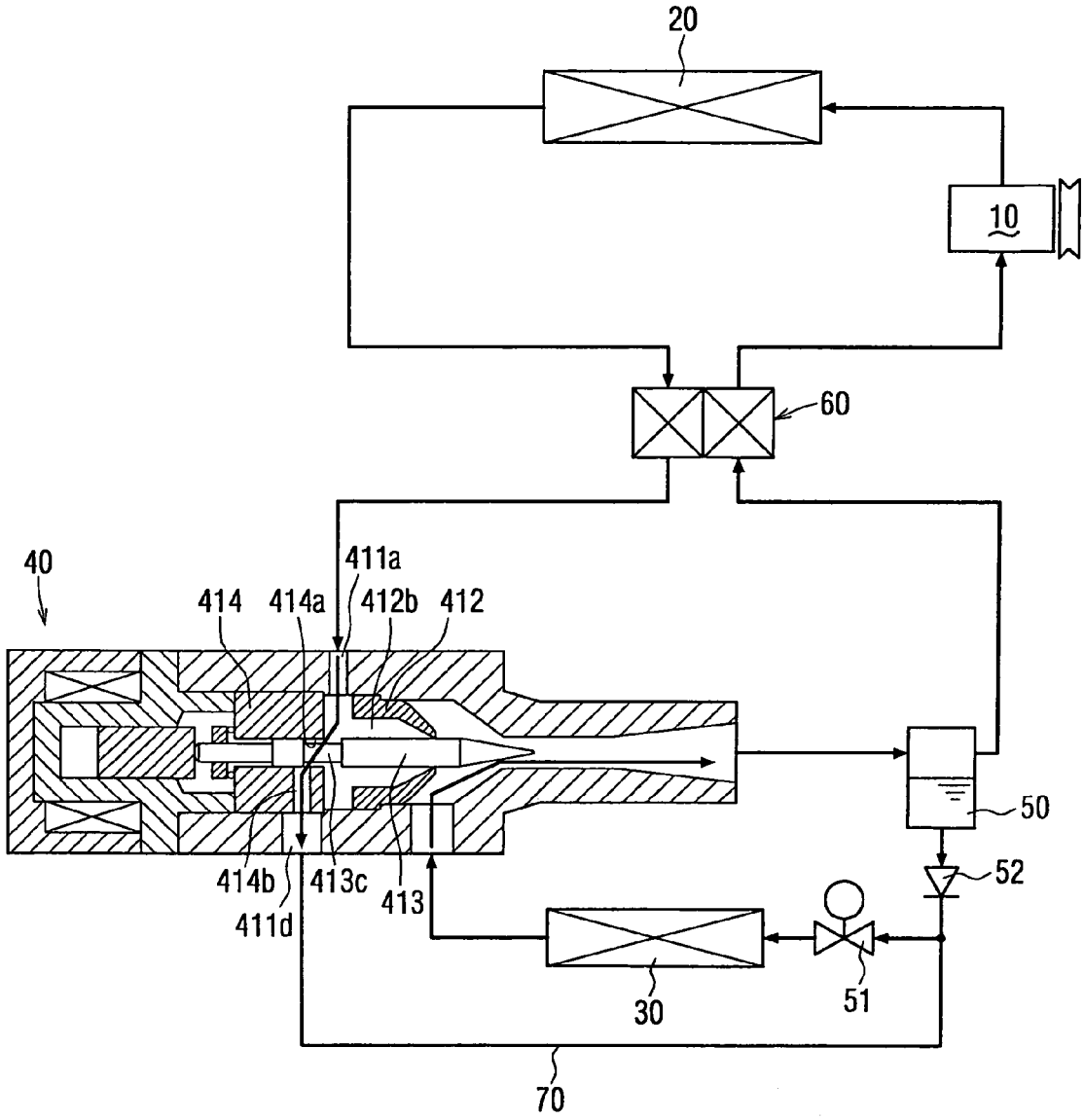
FIG. 2 is also a schematic view of the ejector cycle according to FIG. 1, in which the ejector cycle is operated in the cooling operation but the refrigerant bypasses an ejector nozzle.
Figure 3A:
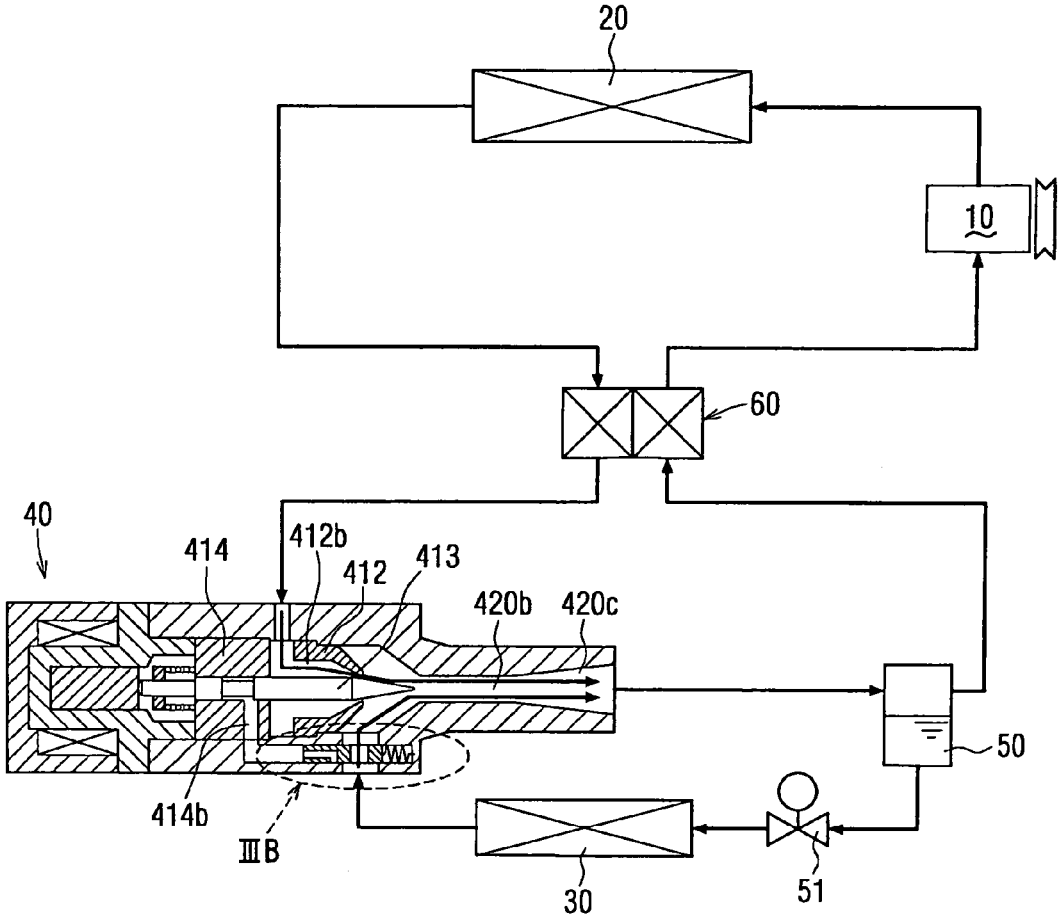
FIG. 3A is a schematic view of an ejector cycle according to a second embodiment of the present invention, and partly showing a cross sectional view of an ejector, in which the ejector cycle is operated in a cooling operation.
Figure 3B:
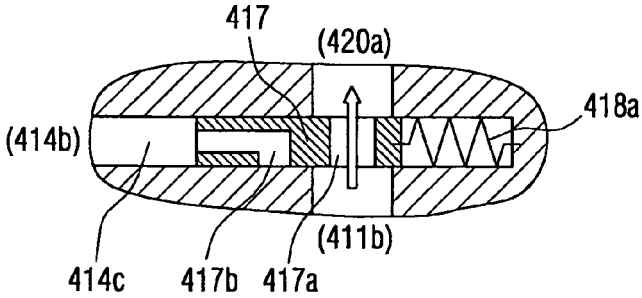
FIG. 3B is an enlarged partial cross sectional view of a portion of an ejector circled by 3B in FIG. 3A.

FIG. 2 shows the ejector cycle of the first embodiment, in which it is operated in the bypass cooling mode. When the input amount of the refrigerant to the ejector 40 is decreased due to a low ambient temperature, a high wind velocity around the outside heat exchanger 20, or a high room temperature, the refrigerant is made to bypass the ejector nozzle 412 and to flow into the evaporator 30, so that a desired cooling performance is obtained.

In this operation, the needle 413 is moved (in the right hand direction in FIG. 2) to close the opening of the nozzle portion 412*a*. With the movement of the needle 413, the circular groove 413*c* comes out of the guide bore 414*a* of the needle guide 414, so that the communication space formed by the circular groove 413*c* is communicated with the inlet port 411*a*, and thereby the bypass port 411*d* is finally communicated with the inlet port 411*a*. As a result, the high-pressure refrigerant discharged from the outside heat exchanger 20 and flowing into the ejector 40 bypasses the ejector nozzle 412 within the ejector 40 to flow out from the bypass port 411*d*, as shown in FIG. 2. The refrigerant then flows into the evaporator 30 through the bypass passage 70, to perform the cooling operation at the evaporator 30.

As above, even when the input amount of the refrigerant to the ejector 40 is decreased due to the low ambient temperature and so on, the desired cooling performance can be obtained by making the refrigerant bypass the ejector nozzle 412. Furthermore, since the bypass channel 414*b* and the passage changeover means (the needle 413, the circular groove 413*c* of the needle 413 and the bypass channel 414*b* of the needle guide 414) are formed in the ejector 40, the structure of the ejector or the ejector cycle can be made simpler. This is because a three way valve, for example, as the passage changeover means is not necessary and additional pipes for the three way valve are correspondingly not required, either.

The cross sectional opening area of the nozzle portion 412*a* is adjusted by the conical end 413*b* of the needle 413 by the axial movement of the needle 413, and in addition the needle 413 controls the opening and closing of the nozzle opening as well as the opening and closing of the bypass channel 414*b* by the axial movement of the needle 413. Accordingly, the structure of the ejector 40 and the structure of the passage changeover means (413, 413*c*, 414*b*) can be made simpler.

(Second Embodiment)

A second embodiment of the present invention will be explained with reference to FIGS. 3A to 4B, which differs from the first embodiment in that a second passage changeover means (a second movable valve 417) is provided in the ejector 40 and thereby the bypass passage 70 and the check valve 52 can be omitted in the second embodiment.

A second bypass channel 414*c* is formed in the common ejector body 411, so that the second bypass channel 414*c* is communicated at its one end with the first bypass channel 414*b* and at the other end with the suction port 411*b*. A second movable valve 417 is inserted in the second bypass channel 414*c* and movable therein in the longitudinal direction. A coil spring 418*a* is disposed in an end of the second bypass channel 414*c*. The second movable valve 417 has a first hole 417*a* to form a first communication passage, which communicates an inlet and outlet sides of the suction port 411*b* at a valve position shown in FIG. 3B (This position corresponds to the valve position during the normal cooling operation). The second movable valve 417 further has a second hole 417*b* to form a second communication passage, which communicates the first bypass channel 414*b* with the suction port 411*b* when the second movable valve 417 is positioned at another valve position shown in FIG. 4B (This position corresponds to the valve position during the bypass cooling operation.)

During the normal cooling operation, the first bypass channel 414*b* is closed by the first passage changeover means (413, 413*c*, 414*b*) as in the same manner to the first embodiment, and thereby no high-pressure refrigerant is supplied to the second bypass channel 414*c*. As a result, the second movable valve 417 is positioned by the spring 418*a* at the valve position shown in FIG. 3B.

(A Normal Cooling Operation)

As already explained, the first bypass channel 414*b* is kept closed during the normal cooling operation and the suction port 411*b* is opened through the first hole 417*a* of the second movable valve 417. And thereby the normal cooling operation is done in the same manner to the first embodiment.

(A Bypass Cooling Operation)

As in the same manner to the first embodiment, when the input amount of the refrigerant to the ejector 40 is decreased due to the low ambient temperature and so on, the refrigerant supplied to the ejector 40 bypasses the ejector nozzle 412 and all of the refrigerant is directly supplied to the evaporator 30, to obtain the desired cooling performance.

In this bypass cooling operation, the needle 413 is at first moved in the right hand direction to close the ejector nozzle 412 and to open the first bypass channel 414*b*, so that the high-pressure refrigerant from the outside heat exchanger 20 flows through the first bypass channel 414*b* to the second bypass channel 414*c*.

Figure 4A:
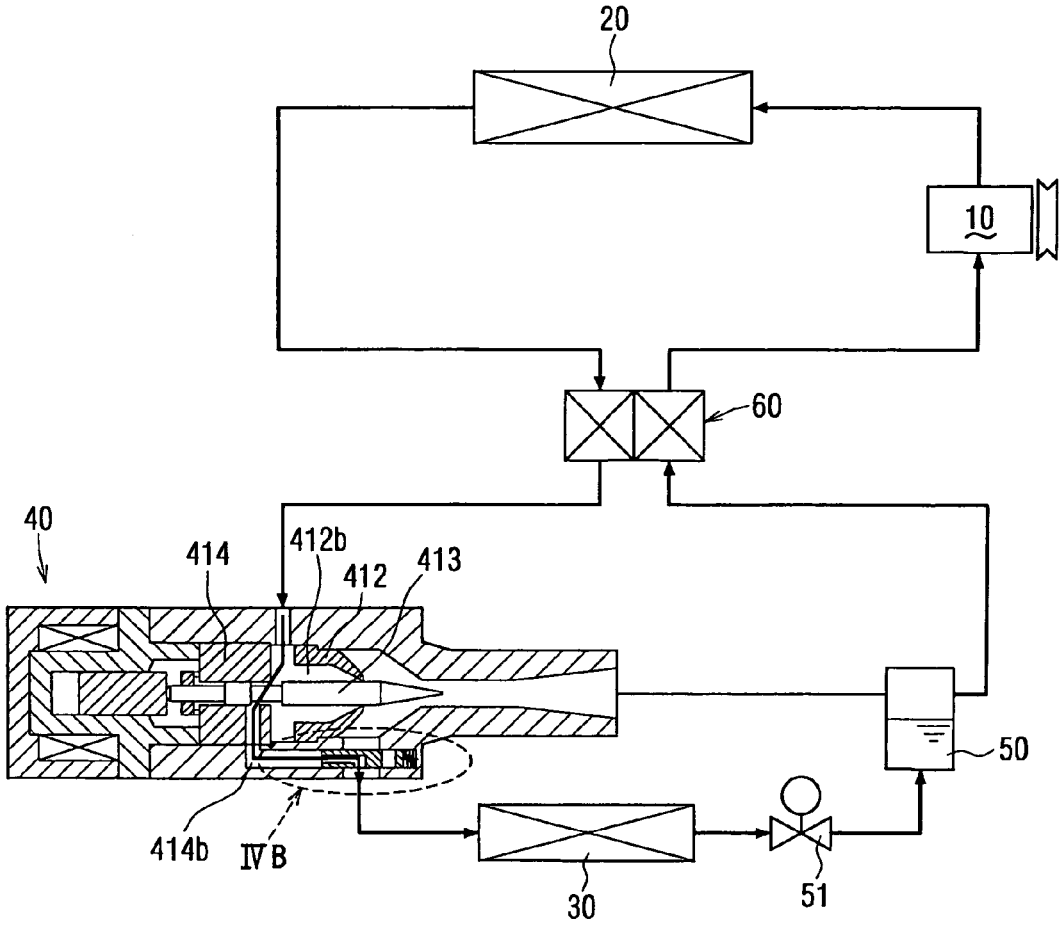
FIG. 4A is also a schematic view of the ejector cycle according to FIG. 3A, in which the ejector cycle is operated in the cooling operation but the refrigerant bypasses an ejector nozzle.
Figure 4B:
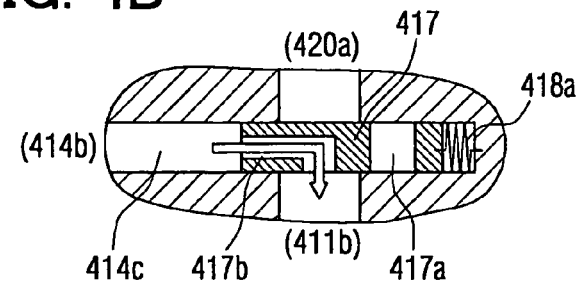
FIG. 4B is an enlarged partial cross sectional view of a portion of an ejector circled by 4B in FIG. 4A.

Then, the second movable valve 417 (as the second passage changeover means) is urged in a direction for compressing the coil spring 418*a*, to close the first hole 417*a* (the first communication passage 417*a*) and to open the second communication passage 417*b*, as shown in FIG. 4B. As a result, the refrigerant flows through the second communication passage 417*b* and the suction port 411*b* to the evaporator 30, at which the refrigerant is evaporated to cool down the air flowing through the evaporator 30.

As understood from this operation, the flow direction of the refrigerant is reversed and thereby the depressurizing valve 51 is fully opened in this bypass cooling operation. And furthermore, the second passage changeover means (the second hole) 417*b* is operated as a depressurizing means.

In the first embodiment, the bypass passage 70 is provided separately from the ejector 40. According to the second embodiment, however, such a separate bypass passage is not necessary, because the flow direction of the refrigerant in the evaporator 30 for the bypass cooling operation is reversed from the flow direction for the normal cooling operation. And thereby the bypass channel (the first and second bypass channels 414*b* and 414*c*) can be formed in the common ejector body of the ejector 40, to make the structure of the ejector and the ejector cycle furthermore simpler.

The second movable valve 417 is so arranged that it moves in the axial direction depending on a balance of the respective urging forces, one of which is the fluid pressure at one end and the other of which is the spring force at the other end. As a result, the second passage changeover means is automatically opened by the fluid pressure of the refrigerant supplied to the second communication passage. Accordingly, any additional driving means for the second movable valve 417 is not necessary, and the structure thereof can be made simpler.

In the second embodiment, the second passage changeover means (the second communication passage 417*b*) is operated as the depressurizing means, and thereby the structure of the ejector cycle can be made simpler.

(Third Embodiment)

A third embodiment of the present invention will be explained with reference to FIGS. 5A to 7B, which differs from the second embodiment in that the ejector cycle and the ejector of the second embodiment are applied to the heat pump air-conditioning apparatus, so that a heating operation can be can be obtained.

Figure 5A:
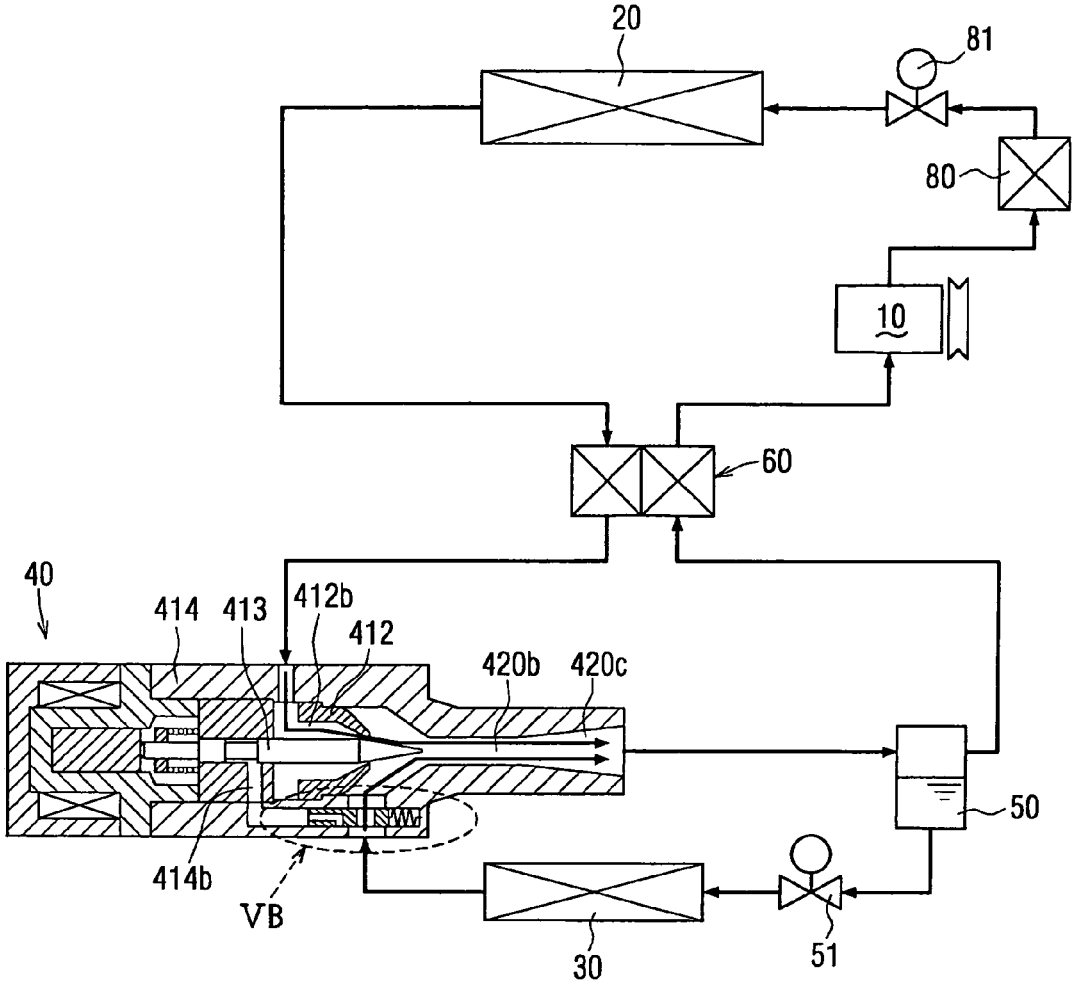
FIG. 5A is a schematic view of an ejector cycle according to a third embodiment of the present invention, and partly showing a cross sectional view of an ejector, in which the ejector cycle is operated in a cooling operation.

In the third embodiment, a heat exchanger (heat radiating device) 80 for a heating operation and a depressurizing valve 81 are provided between the compressor 10 and the outside heat exchanger 20, as shown in FIG. 5A. The other components for the ejector cycle and the structure of the ejector 40 are identical to those shown in FIGS. 3A to 4B.

(A Normal Cooling Operation)

Figure 5B:
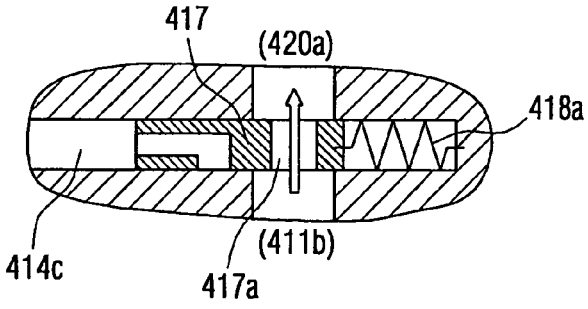
FIG. 5B is an enlarged partial cross sectional view of a portion of an ejector circled by 5B in FIG. 5A.

The refrigerant from the compressor 10 flows through the heat exchanger 80 (the first heat exchanger) and the outside heat exchanger 20 (the second heat exchanger) to the ejector 40. The refrigerant is then ejected through the ejector nozzle 412 and the refrigerant is sucked from the evaporator 30, as shown in FIGS. 5A and 5B. Those refrigerants are depressurized and mixed at the ejector 40 and return to the gas-liquid separator 50, as in the same manner in the second embodiment.

(A Bypass Cooling Operation)

Figure 6A:
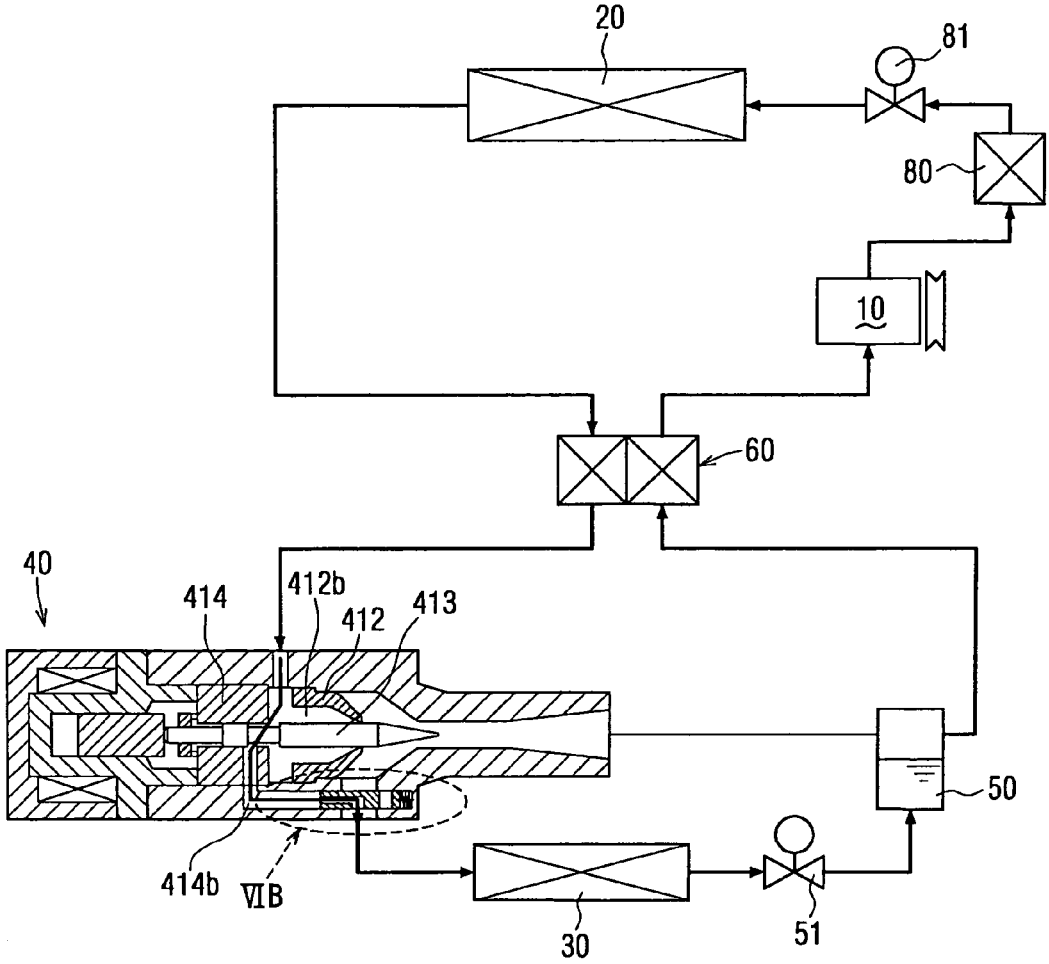
FIG. 6A is also a schematic view of the ejector cycle according to FIG. 5A, in which the ejector cycle is operated in the cooling operation but the refrigerant bypasses an ejector nozzle.
Figure 6B:
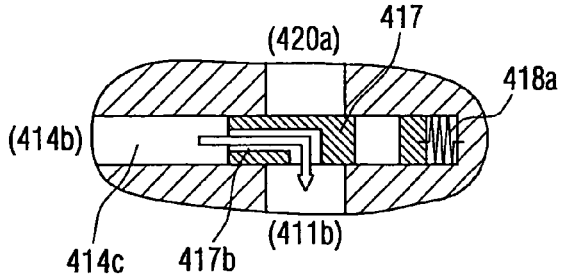
FIG. 6B is an enlarged partial cross sectional view of a portion of an ejector circled by 6B in FIG. 6A.

When the input amount of the refrigerant to the ejector 40 is decreased due to the low ambient temperature and so on, the refrigerant supplied to the ejector 40 bypasses the ejector nozzle 412 and all of the refrigerant is directly supplied to the evaporator 30, as shown in FIGS. 6A and 6B to obtain the desired cooling performance, as in the same manner to the second embodiment.

(A Heating Operation)

When the compressor 10 starts its operation, the compressed high-pressure and high-temperature refrigerant is pumped out to the first heat exchanger 80, at which the heat of the refrigerant is radiated to perform a heating operation. The refrigerant is then flows to the second heat exchanger 20 through the depressurizing valve 81, at which the refrigerant is depressurized. The refrigerant flowing into the second heat exchanger 20 absorbs the heat from the ambient air, and then flows to the ejector 40.

Figure 7A:
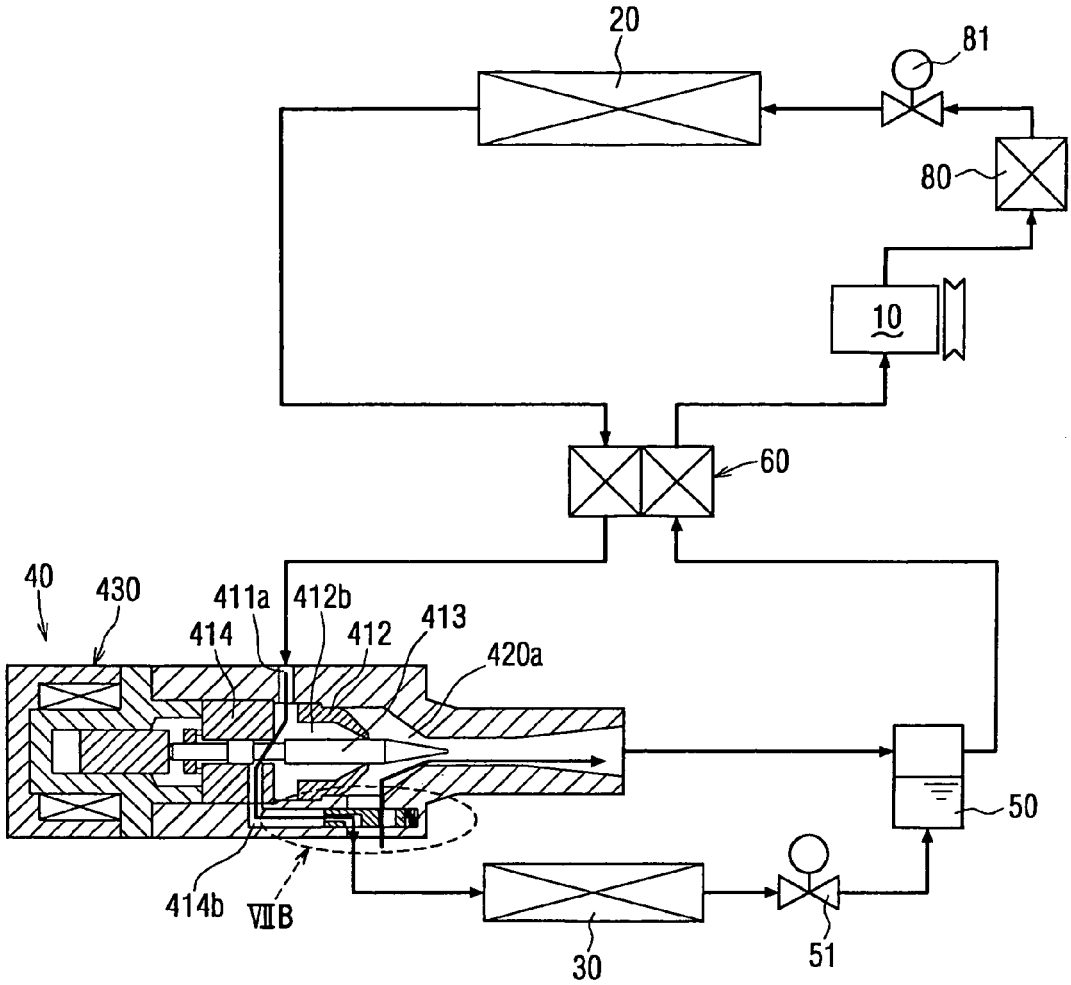
FIG. 7A is furthermore a schematic view of the ejector cycle according to FIG. 5A, in which the ejector cycle is operated in the heating operation.

In the ejector 40, the needle 413 is moved by the driving portion 430 in the right hand direction in FIG. 7A, so that the opening of the ejector nozzle 412 is closed and the first bypass channel 414*b* is communicated with the inlet port 411*a*. The refrigerant from the second heat exchanger 20 bypasses the ejector nozzle 412 and flows into the first bypass channel 414*b*.

Figure 7B:
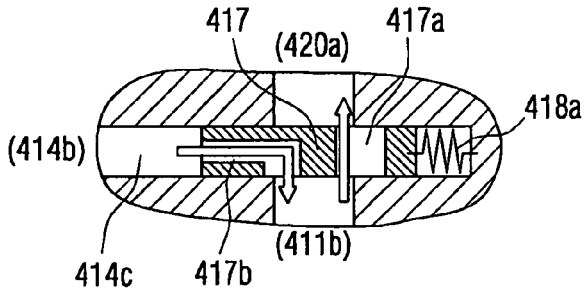
FIG. 7B is an enlarged partial cross sectional view of a portion of an ejector circled by 7B in FIG. 7A.

The second movable valve 417 is moved in the right hand direction in FIG. 7B by a fluid pressure of the refrigerant introduced into the second bypass channel 414*c*. Since the fluid pressure of the refrigerant in this heating operation is different from that of the bypass cooling operation (the pressure in the bypass cooling operation is larger than the pressure in the heating operation), and the spring force of the spring 418*a* is so designed that the second movable valve 417 is positioned at its middle valve position, as shown in FIG. 7B. In this valve position, the second bypass channel 414*c* is communicated with the suction port 411*b* through the second hole 417*b* and with the suction portion 420*a* through the first hole 417*a*.

As a result, a major portion of the refrigerant from the first and second bypass channels 414*b* and 414*c* flows into the suction portion 420*a* by turning at the suction port 411*b*, and further flows through the inside of the ejector 40 to the gas-liquid separator 50, because of a lower fluid resistance in this passage than the passage through the evaporator 30. As above, since the refrigerant bypasses the ejector nozzle 412, a pressure loss can be suppressed to a small amount.

In the above heating operation, the refrigerant is circulated in the heating cycle with a smaller pressure loss, the desired heating performance can be obtained at the heat exchanger 80.

(Fourth Embodiment)

A fourth embodiment of the present invention will be explained with reference to FIGS. 8A to 10C, which differs from the third embodiment in that the needle guide 414 is replaced by a movable needle guide 414A for opening and closing the second bypass channel 414*c* and a third passage changeover means (a third movable valve 419) is provided in the common ejector body 411 so that the refrigerant bypasses the nozzle 412 during the heating operation.

Figure 8A:
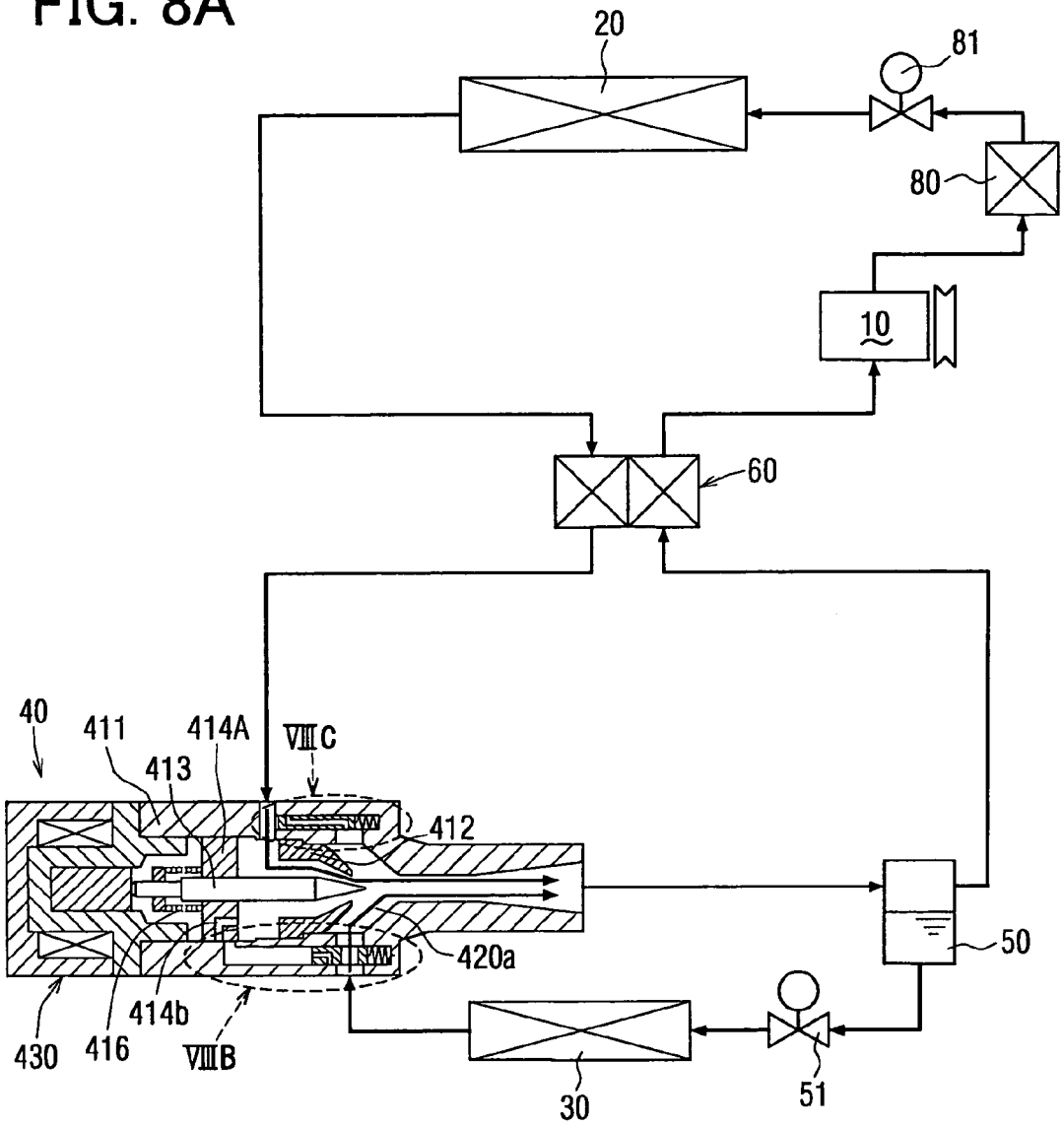
FIG. 8A is a schematic view of an ejector cycle according to a fourth embodiment of the present invention, and partly showing a cross sectional view of an ejector, in which the ejector cycle is operated in a cooling operation.

The movable needle guide 414A is inserted into a cylindrical bore of the common ejector body 411 and movably held in the longitudinal direction. The movable needle guide 414A is linked with the driving portion 430 through the spring 416, so that the movable needle guide 414A is driven in the right hand direction of FIG. 8A together with the needle 413. The first bypass channel 414*b* formed in the movable needle guide 414A is communicated at its one end with the inside space of the cylindrical bore, and the other end of the first bypass channel 414*b* is terminated at an outer peripheral surface of the movable needle guide 414A, so that the other end of the first bypass channel 414*b* is closed by the inner peripheral surface of the cylindrical surface, as shown in FIG. 8A, when the driving portion 430 is not activated. Namely, when the driving portion 430 is not activated, the movable needle guide 414A is pushed by the fluid pressure of the refrigerant and held at its left-most position shown in FIG. 8A.

Figure 9A:
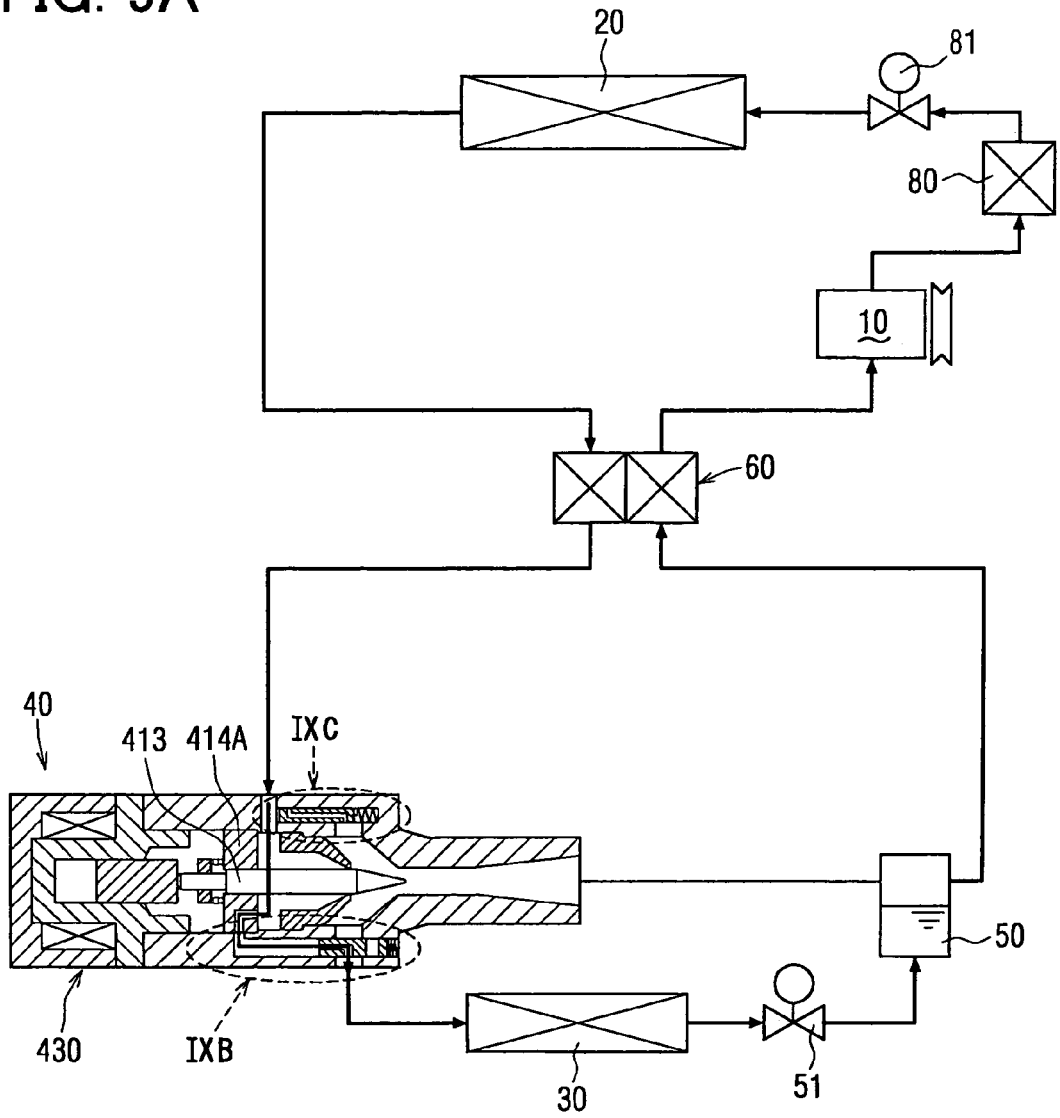
FIG. 9A is also a schematic view of the ejector cycle according to FIG. 8A, in which the ejector cycle is operated in the cooling operation but the refrigerant bypasses an ejector nozzle.
Figure 10A:
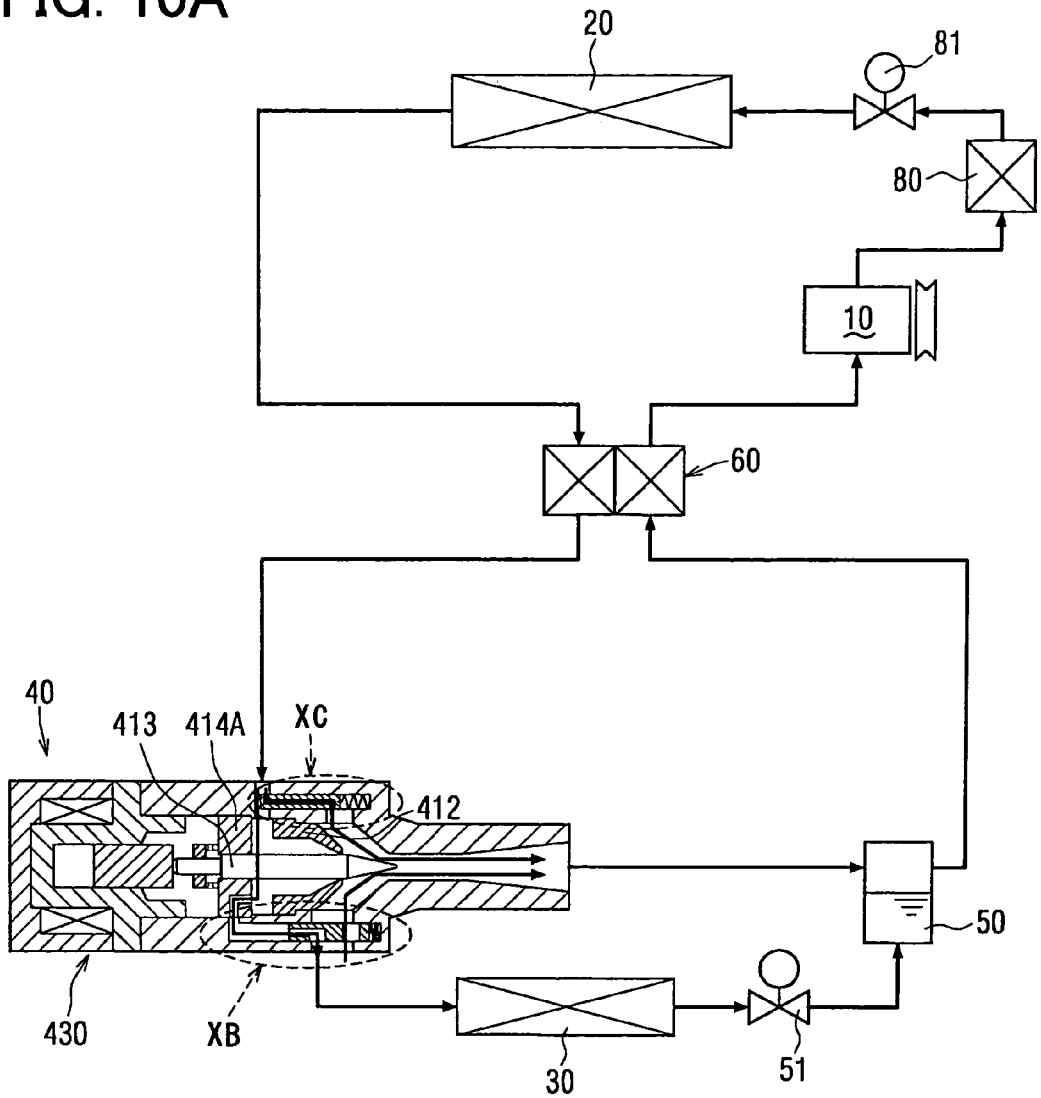
FIG. 10A is furthermore a schematic view of the ejector cycle according to FIG. 8A, in which the ejector cycle is operated in the heating operation.

When the driving portion 430 is activated, on the other hand, the needle 413 as well as the movable needle guide 414A is driven in the right hand direction, and thereby the other end of the first bypass channel 414*b* is brought into communication with the second bypass channel 414*c*, as shown in FIGS. 9A and 10A.

Figure 8B:
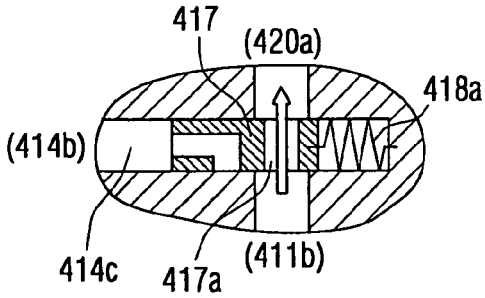
FIG. 8B is an enlarged partial cross sectional view of a portion of an ejector circled by 8B in FIG. 8A.
Figure 8C:
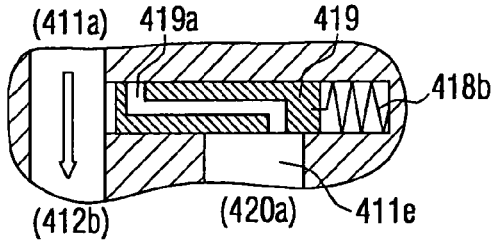
FIG. 8C is an enlarged partial cross sectional view of a portion of an ejector circled by 8C in FIG. 8A.

A third bypass channel 411*e* is formed in the common ejector body 411 of the ejector 40, as shown in FIG. 8C, in such a manner that one end thereof is opening to the inlet port 411*a* and the other end is opening to the inside space of the cylindrical bore (the suction portion 420*a*) of the common ejector body 411 at a downstream side of the nozzle 412. A third movable valve 419 is movably disposed in the third bypass channel 411*e*. A coil spring 418*b* is disposed in the third bypass channel 411*e* for urging the third movable valve 419 in a direction that one end of the third movable valve 419 projects into the inlet port 411*a*, as shown in FIG. 10C. When the fluid pressure of the refrigerant flowing through the inlet port 411*a* is high, then the third movable valve 419 is pressed by the fluid pressure in the opposite direction against the spring force of the coil spring 418*b*, so that the entire body of the third movable valve 419 is retracted into the third bypass channel 411*e*, as shown in FIGS. 8C and 9C.

Figure 9B:
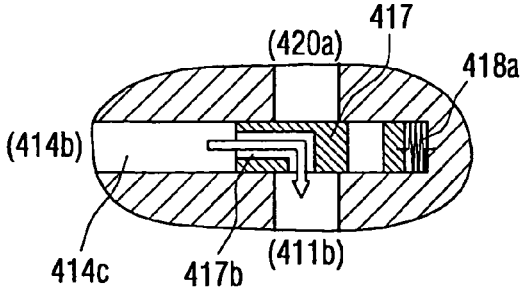
FIG. 9B is an enlarged partial cross sectional view of a portion of an ejector circled by 9B in FIG. 9A.
Figure 9C:
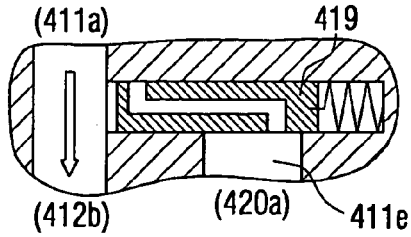
FIG. 9C is an enlarged partial cross sectional view of a portion of an ejector circled by 9C in FIG. 9A.

A third hole 419*a* (a third communication passage) is formed in the third movable valve 419, which is communicated at its one end with the inside space of the cylindrical bore (the suction portion 420*a*) of the common ejector body 411 at the downstream side of the nozzle 412, while the other end of which is terminated at an outer peripheral surface of the third movable valve 419, so that the other end of the hole 419*a* is closed by the inner peripheral surface of the third bypass channel 411*e*, as shown in FIGS. 8C and 9C, when the fluid pressure of the refrigerant flowing through the inlet port 411*a* is high.

When, on the other hand, the fluid pressure of the refrigerant flowing through the inlet port 411*a* becomes lower, the third movable valve 419 is moved by the spring force of the coil spring 418*b* in the direction that the one end of the valve 419 projects into the inlet port 411*a*, as shown in FIG. 10C, so that the one end of the hole 419*a* opens to the inlet port 411*a*. As a result, the inlet port 411*a* is also communicated with the suction portion 420*a*.

(A Normal Cooling Operation)

The refrigerant from the compressor 10 flows through the heat radiating device 80 (the first heat exchanger) and the outside heat exchanger 20 (the second heat exchanger) to the ejector 40. The fluid pressure of the refrigerant flowing through the inlet port 411*a* is high in this cooling operation, so that the third movable valve 419 is retracted into the third bypass channel 411*e*, as shown in FIG. 8C, to close the third bypass channel 411*e*. In this cooling operation, since the driving portion 430 is not activated and thereby the movable nozzle guide 414A is urged by the high pressure of the refrigerant to be placed at its rear-most position shown in FIG. 8A, so that the first bypass channel 414*b* is also closed. As a result, the refrigerant is ejected through the ejector nozzle 412 and the refrigerant is sucked from the evaporator 30, as shown in FIGS. 8A and 8B. Those refrigerants are depressurized and mixed at the ejector 40 and return to the gas-liquid separator 50, as in the same manner in the third embodiment.

(A Bypass Cooling Operation)

When the input amount of the refrigerant to the ejector 40 is decreased due to the low ambient temperature and so on, the refrigerant supplied to the ejector 40 is guided to bypass the ejector nozzle 412 and all of the refrigerant is directly supplied to the evaporator 30.

In this bypass cooling operation, the fluid pressure of the refrigerant flowing through the inlet port 411*a* is still high, so that the third movable valve 419 is kept at its retracted position, as shown in FIG. 9C.

Furthermore, in this bypass cooling operation, the driving portion 430 is activated to drive the needle 413 and the movable needle guide 414A to move those parts in the right hand direction, as shown in FIG. 9A, so that the opening of the ejector nozzle 412 is closed and the first bypass channel 414*b* is opened. When the first bypass channel 414*b* is opened, the fluid pressure of the refrigerant is applied to the second movable valve 417 to move it in the right hand direction, as shown in FIG. 9B, to open the second bypass channel 414*c*. As a result, in this bypass cooling operation, all of the refrigerant bypasses the ejector nozzle 412 and flows into the evaporator 30, as shown in FIGS. 9A and 9B.

(A Heating Operation)

When the compressor 10 starts with its operation, the compressed high-pressure and high-temperature refrigerant is pumped out to the first heat exchanger 80, at which the heat of the refrigerant is radiated to perform a heating operation. The refrigerant is then flows to the second heat exchanger 20 through the depressurizing valve 81, at which the refrigerant is depressurized. The refrigerant flowing into the second heat exchanger 20 absorbs the heat from the ambient air, and then flows to the ejector 40, as in the same manner to the third embodiment.

In this heating operation, since the fluid pressure of the refrigerant from the second heat exchanger 20 is lower than that for the cooling or bypass cooling operation, the third movable valve 419 is moved in the left hand direction by the spring force of the coil spring 418*b*, as shown in FIG. 10C, so that the third bypass channel 411*e* is opened to communicate the inlet port 411*a* with the suction portion 420*a* of the ejector 40 through the hole 419*a*.

Figure 10B:
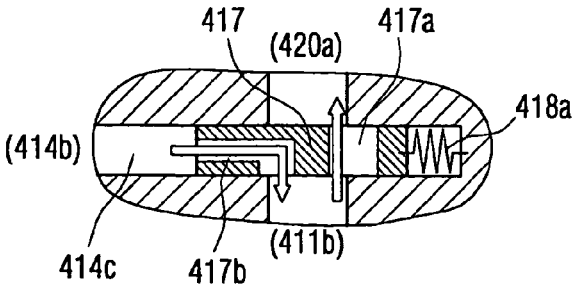
FIG. 10B is an enlarged partial cross sectional view of a portion of an ejector circled by 10B in FIG. 10A.
Figure 10C:
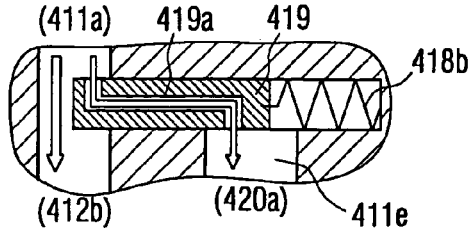
FIG. 10C is an enlarged partial cross sectional view of a portion of an ejector circled by 10C in FIG. 10A.
Figure 11:
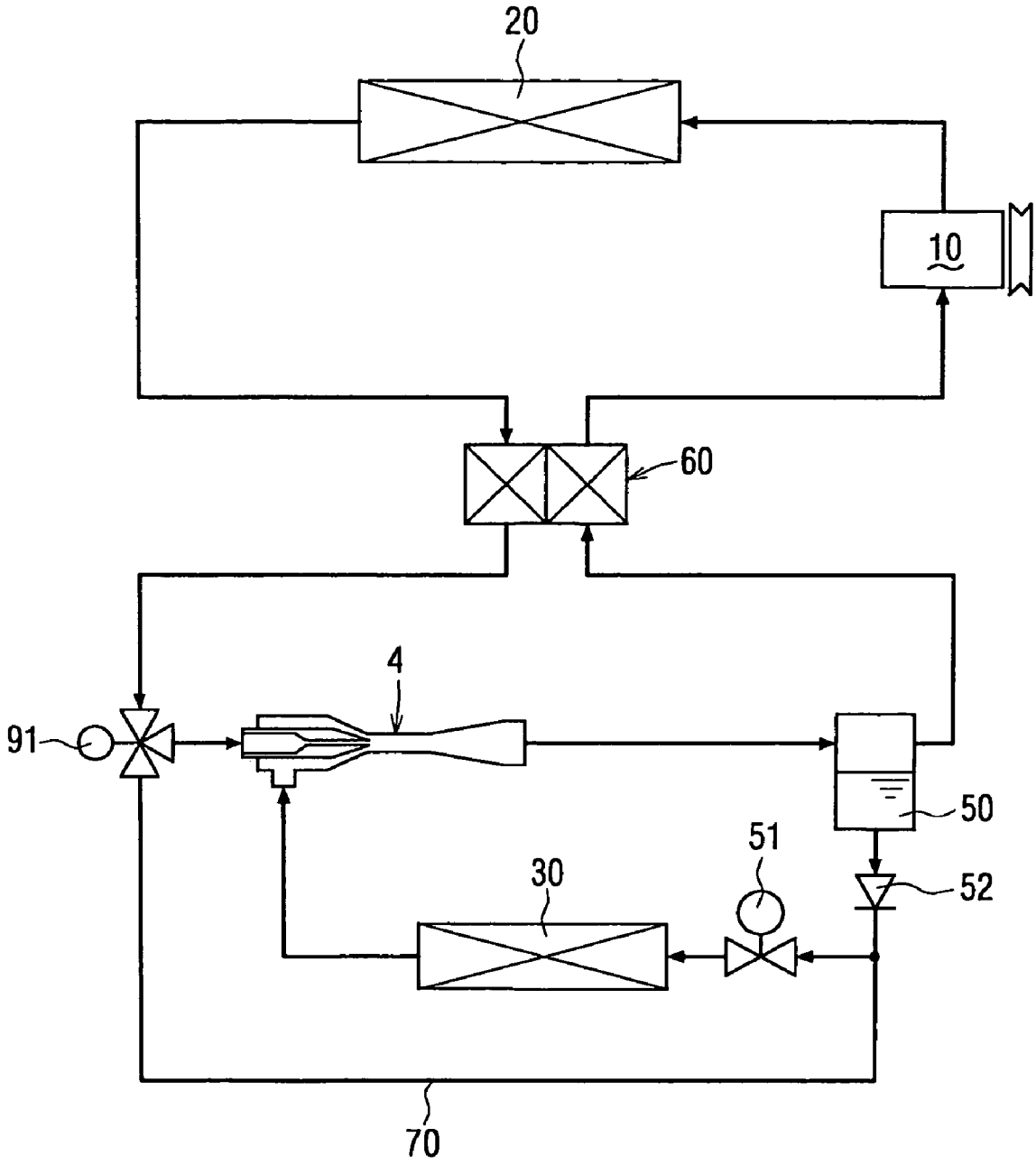
FIG. 11 PRIOR ART
FIG. 11 is a schematic view of a prior art ejector cycle.
Figure 12:
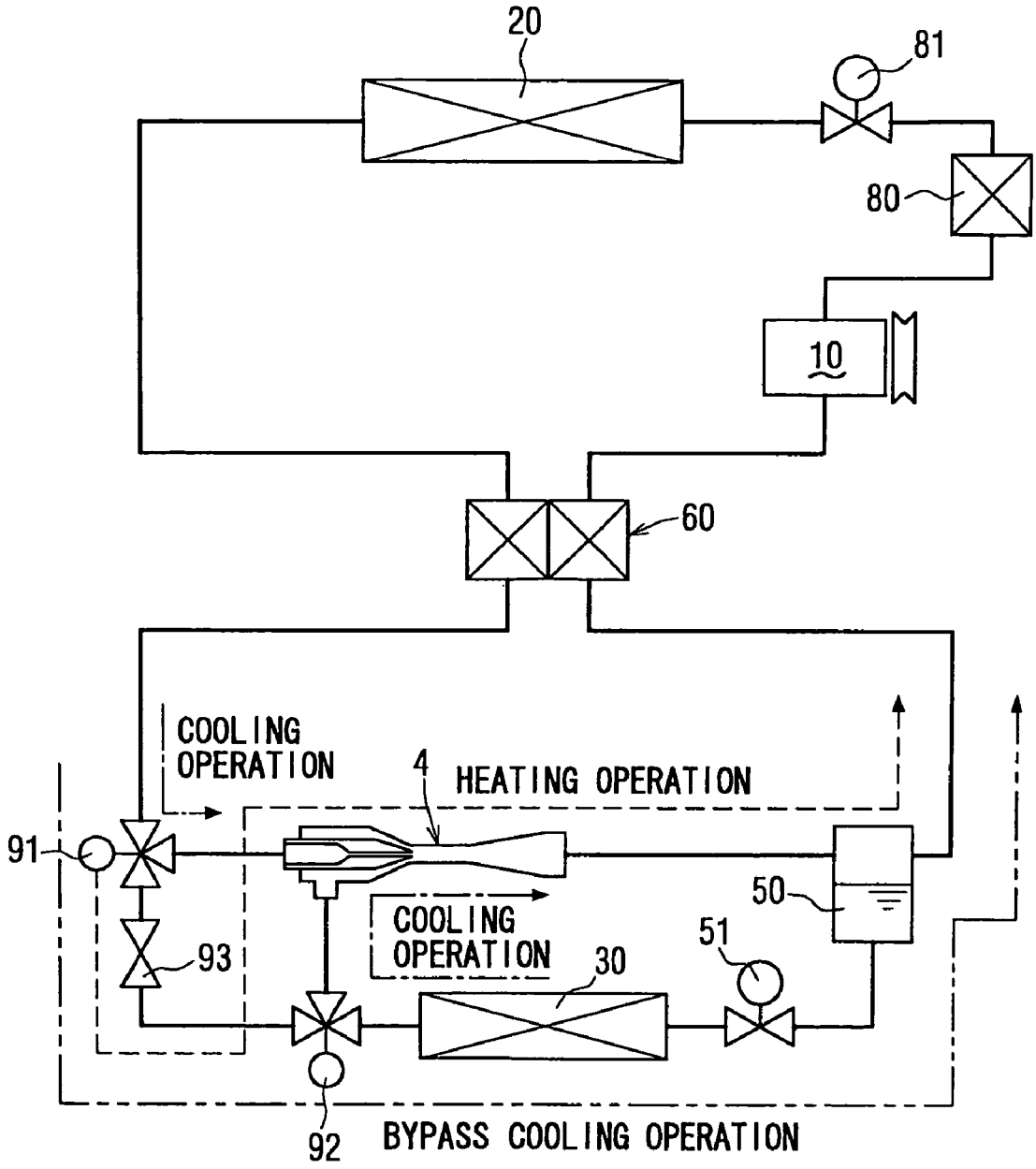
FIG. 12 PRIOR ART
FIG. 12 is a schematic view of a prior art ejector cycle used in a heat pump air-conditioning apparatus.

In this heating operation, the driving portion 430 is also activated so that the needle 413 and the movable needle guide 414A are moved to and kept at the right hand position, as shown in FIG. 10A, so that the first bypass channel 414*b* is opened. Then the fluid pressure of the refrigerant is applied to the second movable valve 417 to move it in the right hand direction, as shown in FIG. 10B. Since the fluid pressure of the refrigerant in this heating operation is lower than that of the bypass cooling operation, the movable valve 417 is held at its middle valve position, at which the first and second holes 417*a* and 417*b* are opened.

As a result, a portion of the refrigerant flows back to the gas-liquid separator 50 through the third bypass channel 411*e*, another portion of the refrigerant flows through the first and second bypass channels 414*b* and 414*c* into the suction portion 420*a* by turning at the suction port 411*b* and finally to the gas-liquid separator 50, and the last but a small portion of the refrigerant flows through the evaporator 30 to the gas-liquid separator 50. As above, since the refrigerant bypasses the nozzle 412, a pressure loss can be suppressed to a small amount.

The third movable valve 419 is so arranged that it moves in the axial direction depending on a balance of the respective urging forces, one of which is the fluid pressure at one end and the other of which is the spring force at the other end. As a result, the third bypass channel is automatically opened by the fluid pressure of the refrigerant flowing in the inlet port 411*a*. Accordingly, any additional driving means for the third movable valve 419 is not necessary, and the structure thereof can be made simpler.

(Other Embodiment)

The above explained ejector and/or ejector cycle can be applied not only to the air-conditioning apparatus having the cooling operation and/or heating operation, as above, but also to a refrigeration unit for a freezer storage, a cold storage, a heating cabinet, or to any other thermal engine, such as a hot water supply apparatus, having the ejector cycle.

The electromagnetic actuator is used as the driving portion 430 of the ejector 40 in the above embodiments. A stepping motor, a linear motor and any other driving means can be used, instead of the electromagnetic actuator.

In the above embodiments, Freon gas, carbon dioxide, carbon hydride or the like can be used as the refrigerant.

What is claimed is:

1. An ejector cycle comprising:

a gas-liquid separator for storing gas-phase and liquid-phase refrigerant;

a compressor connected to the gas-liquid separator and for sucking refrigerant from the gas-liquid separator and compressing the same;

a heat exchanger connected to the compressor and for cooling down the refrigerant pumped out from the compressor;

an evaporator for evaporating refrigerant; and an ejector connected to the heat exchanger, the evaporator and the gas-liquid separator, wherein the ejector comprises:

an inlet port connected to the heat exchanger, through which the refrigerant from the heat exchanger is supplied to the ejector;

a suction port connected to the evaporator, through which the refrigerant is sucked from the evaporator into the ejector;

a discharge port connected to the gas-liquid separator, through which the refrigerant is discharged from the ejector to the gas-liquid separator;

an ejector nozzle for depressurizing and expanding the refrigerant from the heat exchanger, by converting pressure energy to speed energy;

a pressure increasing portion for sucking the gas-phase refrigerant from the evaporator by a refrigerant flow ejected from the nozzle and having a high flow velocity, for mixing the refrigerant ejected from the ejector nozzle with the refrigerant sucked from the evaporator, and for increasing fluid pressure of the refrigerant while converting the speed energy of the refrigerant to pressure energy;

a first bypass channel for making the refrigerant bypass the nozzle; and a first passage changeover means provided in the ejector for leading the high-pressure refrigerant from the heat exchanger to the ejector nozzle in a normal cooling operation, and for changing a flow passage in order that the refrigerant from the heat exchanger bypasses the ejector nozzle and for leading the refrigerant to the bypass channel in a bypass cooling operation in which an input amount of the refrigerant from the heat exchanger to the ejector is decreased.

2. An ejector cycle according to claim 1, further comprising:

a bypass passage connected between a bypass port formed in the ejector and the evaporator; and a depressurizing valve provided in the bypass passage, wherein the refrigerant flows through the bypass passage and the depressurizing valve to the evaporator in the bypass cooling operation.

3. An ejector cycle according to claim 1, wherein the ejector further comprises:

a needle guide;

a needle movably supported by the needle guide, a forward end of the needle being inserted into an opening of the ejector nozzle, to adjust a cross sectional area of the opening by moving the needle in its axial direction, wherein the needle opens and closes the first bypass channel.

4. An ejector cycle according to claim 1, wherein the ejector further comprises a second passage changeover means having:

a second bypass channel provided in the ejector between the first bypass channel and the suction port; and a second movable valve movably arranged in the second bypass channel for opening and closing the suction port and the second bypass channel, wherein the second movable valve closes the second bypass channel and opens the suction port during the normal cooling operation, whereas the second movable valve opens the second bypass channel and closes the suction port when the first bypass channel is opened.

5. An ejector cycle according to claim 4, wherein the second movable valve movably disposed in the second bypass channel is axially moved by a difference of force applied to both ends.

6. An ejector cycle according to claim 4, wherein the second passage changeover means operates as a depressurizing means, when the refrigerant flows through the second bypass channel to the evaporator.

7. An ejector cycle according to claim 1, further comprising:

a heat radiating device connected between the compressor and the heat exchanger for radiating heat of the refrigerant from the compressor to the air around the heat radiating device; and a depressurizing device connected between the heat radiating device and the heat exchanger for depressurizing the refrigerant from the heat radiating device, wherein the opening of the ejector nozzle is closed and the first and second bypass channels as well as the suction port are opened by the first and second passage changeover means, when the ejector cycle operates in a heating operation, so that the refrigerant from the heat exchanger bypasses the ejector nozzle and flows through the first and second bypass channels and the suction port to the gas-liquid separator.

8. An ejector cycle comprising:

a gas-liquid separator for storing gas-phase and liquid-phase refrigerant;

a compressor connected to the gas-liquid separator and for sucking refrigerant from the gas-liquid separator and compressing the same;

a heat radiating device connected to the compressor for radiating heat of the refrigerant from the compressor to the air around the heat radiating device; and a depressurizing device connected to the heat radiating device for depressurizing the refrigerant from the heat radiating device, a heat exchanger connected to the depressurizing device for cooling down the refrigerant;

an evaporator for evaporating refrigerant; and an ejector connected to the heat exchanger, the evaporator and the gas-liquid separator, wherein the ejector comprises:

an inlet port connected to the heat exchanger, through which the refrigerant from the heat exchanger is supplied to the ejector;

a suction port connected to the evaporator, through which the refrigerant is sucked from the evaporator into the ejector;

a discharge port connected to the gas-liquid separator, through which the refrigerant is discharged from the ejector to the gas-liquid separator;

an ejector nozzle for depressurizing and expanding the refrigerant from the heat exchanger, by converting pressure energy to speed energy;

a pressure increasing portion for sucking the gas-phase refrigerant from the evaporator by a refrigerant flow ejected from the nozzle and having a high flow velocity, for mixing the refrigerant ejected from the ejector nozzle with the refrigerant sucked from the evaporator, and for increasing fluid pressure of the refrigerant while converting the speed energy of the refrigerant to pressure energy;

a first bypass channel for making the refrigerant bypass the nozzle;

a first passage changeover means provided in the ejector for leading the high-pressure refrigerant from the heat exchanger to the ejector nozzle in a normal cooling operation, and for changing a flow passage in order that the refrigerant from the heat exchanger bypasses the ejector nozzle and for leading the refrigerant to the bypass channel in a bypass cooling operation in which an input amount of the refrigerant from the heat exchanger to the ejector is decreased;

a second bypass channel provided in the ejector between the first bypass channel and the suction port; and a second movable valve movably arranged in the second bypass channel for opening and closing the suction port and the second bypass channel, wherein the second movable valve closes the second bypass channel and opens the suction port during the normal cooling operation, whereas the second movable valve opens the second bypass channel and closes the suction port when the first bypass channel is opened.

9. An ejector cycle according to claim 8, wherein the ejector further comprises:

a third bypass channel provided in the ejector, so that one end is communicated with an inlet port of the ejector, while the other end is communicated with a suction portion of the ejector; and a third movable valve movably arranged in the third bypass channel for opening and closing the third bypass channel, wherein the third movable valve closes the third bypass channel when fluid pressure of the refrigerant flowing through the inlet port is high during the cooling operation, whereas the third movable valve opens the third bypass channel when the fluid pressure of the refrigerant becomes lower during a heating operation so that a portion of the refrigerant flows to the suction portion through the third bypass channel.

10. An ejector cycle according to claim 9, wherein the third movable valve movably disposed in the third bypass channel is axially moved by a difference of force applied to both ends.

11. An ejector cycle according to claim 9, wherein the second passage changeover means operates as a depressurizing means, when the refrigerant flows through the second bypass channel to the evaporator.

* * * * *